US007735286B2

(12) United States Patent
Trabue et al.

(10) Patent No.: US 7,735,286 B2
(45) Date of Patent: Jun. 15, 2010

(54) ROOF AND WALL COVERING WITH IMPROVED CORNER CONSTRUCTION

(75) Inventors: Robert Trabue, Hollywood, FL (US); Stefan Schwarz, Coral Springs, FL (US)

(73) Assignee: Exteria Building Products, Miami, FL (US)

( * ) Notice: Subject to any disclaimer, the term of this patent is extended or adjusted under 35 U.S.C. 154(b) by 222 days.

(21) Appl. No.: 11/702,256

(22) Filed: Feb. 5, 2007

(65) Prior Publication Data

US 2008/0184645 A1 Aug. 7, 2008

(51) Int. Cl.
*E04D 1/00* (2006.01)
*E04B 2/00* (2006.01)
*E04B 1/00* (2006.01)

(52) U.S. Cl. ..... 52/518; 52/287.1; 52/748.1; 52/506.1; 52/288.1; 52/555; 52/520

(58) Field of Classification Search ..... 52/531, 52/520, 521, 528, 518, 506.01, 302.1, 287.1, 52/530, 539, 555, 747.1, 314, 748.1, 288.1, 52/557, 276, 748, 188.1
See application file for complete search history.

(56) References Cited

U.S. PATENT DOCUMENTS

| | | | | |
|---|---|---|---|---|
| 2,607,449 | A * | 8/1952 | Daniels | 52/553 |
| 2,831,244 | A | 4/1958 | Adell | |
| 2,849,757 | A * | 9/1958 | Meldrum | 52/276 |
| 3,651,610 | A * | 3/1972 | Donahue | 52/278 |
| 4,015,391 | A * | 4/1977 | Epstein et al. | 52/520 |
| 4,464,872 | A * | 8/1984 | Eaton | 52/276 |
| 5,347,784 | A | 9/1994 | Crick et al. | |
| 5,537,792 | A * | 7/1996 | Moliere | 52/531 |
| 6,237,294 | B1 | 5/2001 | Rygiel | |
| 6,684,587 | B2 * | 2/2004 | Shaw et al. | 52/288.1 |
| 2002/0000068 | A1 * | 1/2002 | Freiborg et al. | 52/57 |
| 2002/0162291 | A1 * | 11/2002 | Steffes et al. | 52/287.1 |
| 2003/0226327 | A1 * | 12/2003 | Perry | 52/287.1 |
| 2004/0159062 | A1 * | 8/2004 | Donlin et al. | 52/506.01 |
| 2006/0059830 | A1 * | 3/2006 | Perry | 52/518 |

* cited by examiner

*Primary Examiner*—Robert J Canfield
*Assistant Examiner*—Babajide Demuren
(74) *Attorney, Agent, or Firm*—Drinker Biddle & Reath LLP

(57) ABSTRACT

A wall covering comprising plastic molded wall panels and corner moldings each formed with simulated cedar shake shingles. The corner molding shingles are mountable in partially overlying relation to the shingles of adjacent wall panels and a previously mounted corner molding. The corner moldings further each have upper marginal edge regions that are positionable into tight fitting underlying relation to the wall panels in a course immediately above the corner molding for providing a more natural hand cut shake appearance. The corner moldings have mounting latches and hooks which are longitudinally severable to permit mounting on all surfaces that define corners substantially greater than 90°, and the corner moldings preferably are formed with different patterns of simulated shake for further contributing to their natural appearance.

32 Claims, 5 Drawing Sheets

ROOF AND WALL COVERING WITH IMPROVED CORNER CONSTRUCTION

FIELD OF THE INVENTION

The present invention relates generally to roof and wall coverings primarily intended for outdoor usage, and more particularly, to roof and wall coverings comprised of relatively large panels which each are molded or otherwise formed with decorative patterns characteristic of conventional roofing and siding materials such as shake, tile, brick or the like.

BACKGROUND OF THE INVENTION

Various synthetic roof and wall coverings are known today, such as those formed of elongated molded thermoplastic wall panels that are nailed or screwed to a wall or roof support surface in horizontal courses or rows in partially overlapping relation to each other so as to provide a substantially water resistant, protective layer over the support surface. Such panels, which usually are identically molded, commonly are formed with one or more rows of simulated building elements, such as shake shingles. Since the panels are identically molded, a panel-to-panel identity can be easily noticed if the panels are not carefully installed. Installation problems particularly occur when installing such synthetic wall and roof coverings about corners of the roof or sidewalls.

Typically, corner moldings are used to join the wall panels at corners of the roof or wall surfaces. In some prior corner moldings, the wall panels must be positioned into abutting relation with a pre-mounted corner molding prior to installation of the wall panel. Such mounting requires precise cutting of the ends of the panels to ensure good installation, which can substantially increase the time and cost of installation. In other known corner moldings in which an end of the wall panel is positionable into a side cavity of the corner molding, unsightly gaps can occur between the corner molding and wall panel by virtue of excessive tolerances. Such gaps also can entrap water and dirt. Moreover, since such corner moldings usually are molded for mounting on wall surfaces that define right angle corners, standard 90° corner moldings typically are not adaptable for use on corner wall surfaces angled substantially greater than 90°, such as corners of bay windows which commonly are angled at 120°.

OBJECTS AND SUMMARY OF THE INVENTION

It is an object of the present invention to provide a wall covering having corner moldings that facilitate more efficient and reliable installation of the wall covering about the corners of roofs and sidewalls.

Another object is to provide a corner molding as characterized above that can be efficiently installed with a more natural and aesthetic appearance.

A further object is to provide a corner molding of the foregoing type which permits efficient and reliable mounting of the corner moldings after installation of the wall panels.

Yet another object is to provide a corner molding of the above kind which has simulated building elements that are mountable in close relation to building elements of adjacent wall panels without unsightly gaps between the corner moldings and wall panels. A related object is to provide such a corner molding in which the building elements thereof are positionable into both overlying and underlying relation with the building elements of the wall panels with a more natural and aesthetic appearance.

Still a further object is to provide corner moldings that have different configurations and which are mountable in alternating repeating fashion for providing an appearance more typical of a natural cedar shake corner construction.

Another object is to provide a corner molding of such type which have a hook and latch arrangement that facilitates efficient mounting and reliable inter-engagement and retention of vertically adjacent corner moldings during installation.

Other objects and advantages of the invention will become apparent upon reading the following detailed description and upon reference to the drawings, in which:

Figure 1:
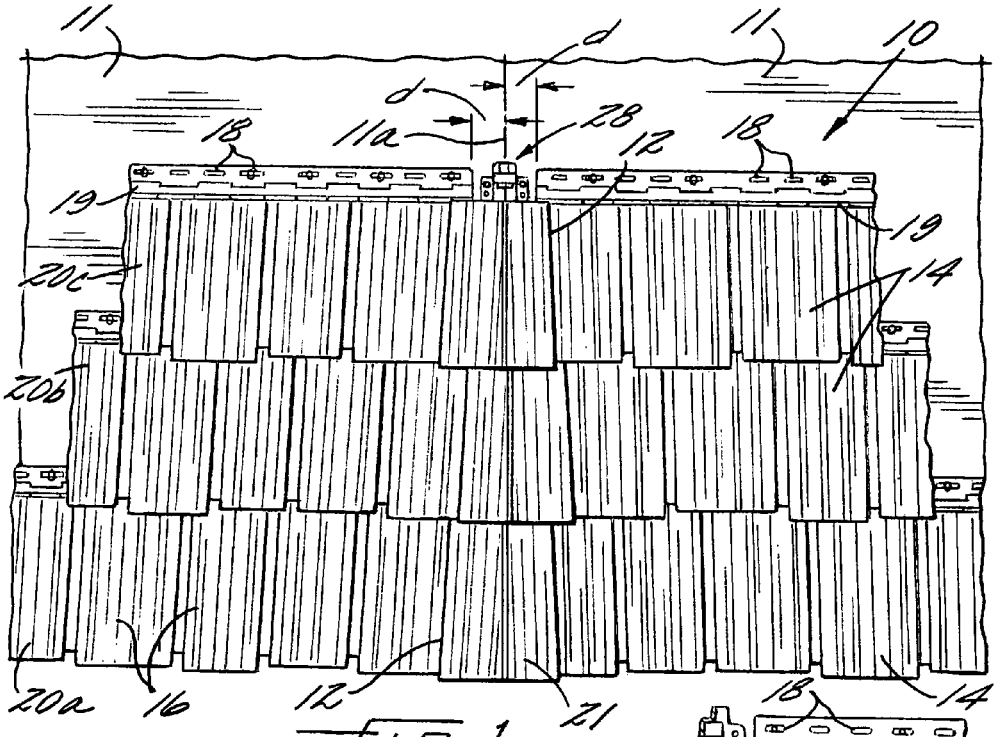
FIG. 1 is a front plan view of a wall covering having a corner construction in accordance with the invention.

While the invention is susceptible of various modifications and alternative constructions, a certain illustrative embodiment thereof has been shown in the drawings and will be described below in detail. It should be understood, however, that there is no intention to limit the invention to the specific form disclosed, but on the contrary, the intention is to cover all modifications, alternative constructions, and equivalents falling within the spirit and scope of the invention.

DETAILED DESCRIPTION OF THE INVENTION

Referring now more particularly to the drawings, there is shown an illustrative wall covering 10 in accordance with the invention mounted about a corner of roof or sidewall surfaces 11 of a building structure. The wall surfaces 11 in this case are at a right angle to each other typical of the exterior corner of the building. The wall covering 10 comprises a plurality of corner moldings 12 mounted in vertically or longitudinally stacked relation to each other and a plurality of wall panels 14 mounted laterally to each side of the corner moldings 12.

The wall panels 14 may be of a known type, such as shown in application Ser. No. 11/588,540 filed Oct. 27, 2006, assigned to the same assignee as the present application, the disclosure of which is incorporated herein by reference. The wall panels 14, which preferably are molded out of relatively thin rigid plastic material, each are formed with simulated building elements 16. In this instance, the panels 14 are formed with building elements 16 in the form simulated cedar shake of irregular width, which are disposed in a horizontal row. The simulated shake 16 each preferably have a front face extending downwardly and outwardly at a slight taper to a wall or support surface upon which the panel is mounted, and the front face is molded with grooves which simulate the grain of the simulated shake. It will be understood that the wall panels 14 could be formed with other forms of simulated shake shingles, or other types of building elements, such as tile, brick and the like.

Figure 10:
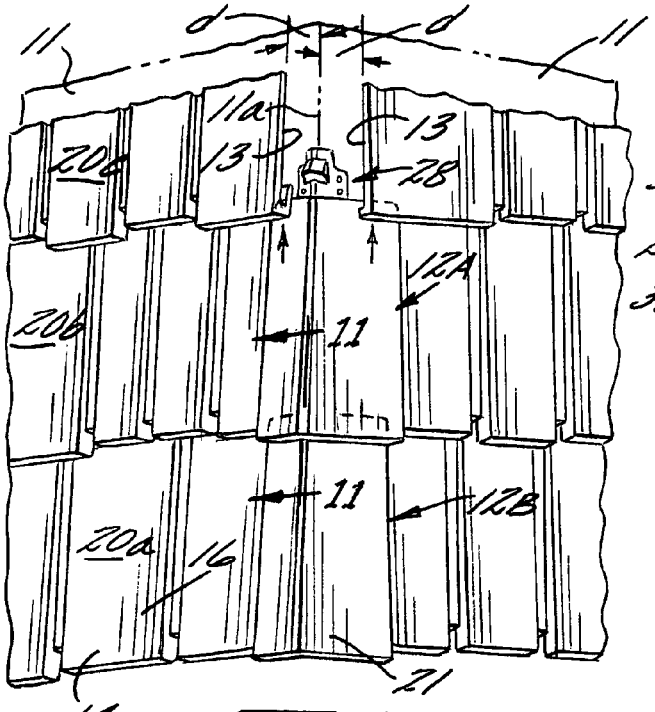
FIG. 10 is a front perspective depicting installation of the corner moldings of the wall covering following premounting of the wall panels.
Figure 11:
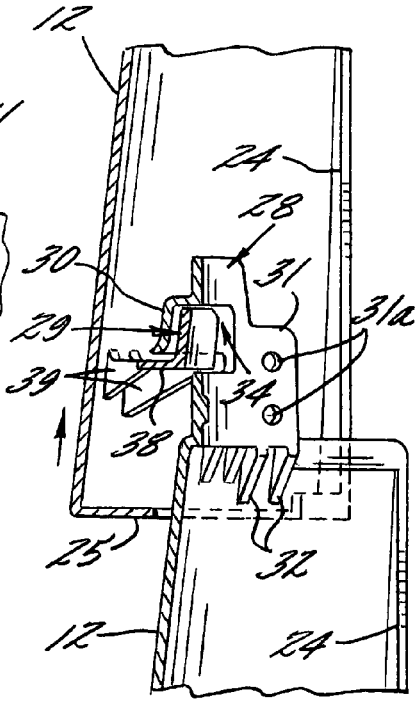
FIG. 11 is an enlarged vertical section showing the inter-engagement of the hook and latch mechanisms of adjoining corner moldings, taken in the plane of line 11-11 in FIG. 10.
Figure 12:
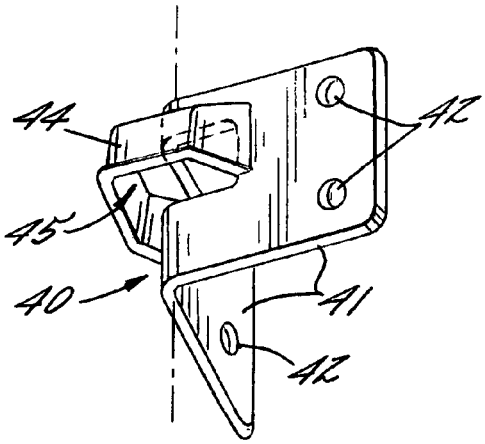
FIG. 12 is an enlarged perspective of a starter clip latch used in installing the initial, lower-most corner molding of the wall covering.
Figure 13:
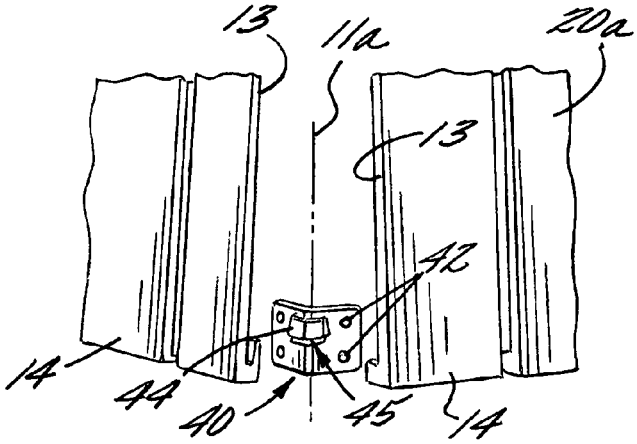
FIG. 13 is a front fragmentary perspective showing mounting of the starter clip on a corner between previously mounted wall panels of the first or lower most row of wall panels.
Figure 15:
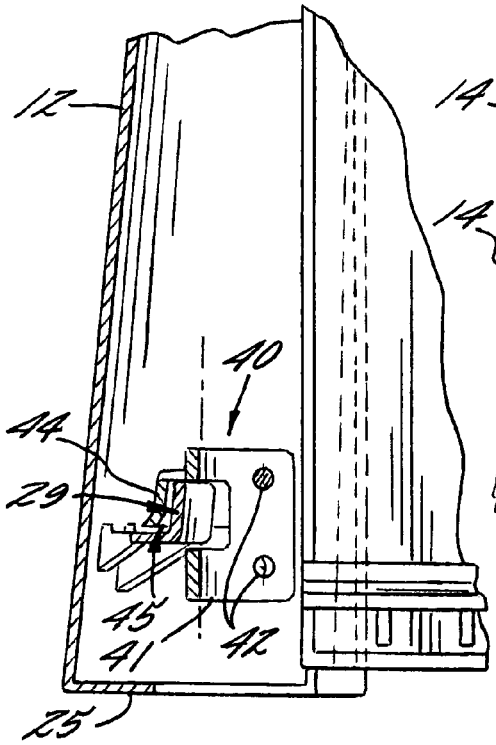
FIG. 15 is an enlarged fragmentary section taken in the plane of line 15-15 in FIG. 14.
Figure 14:
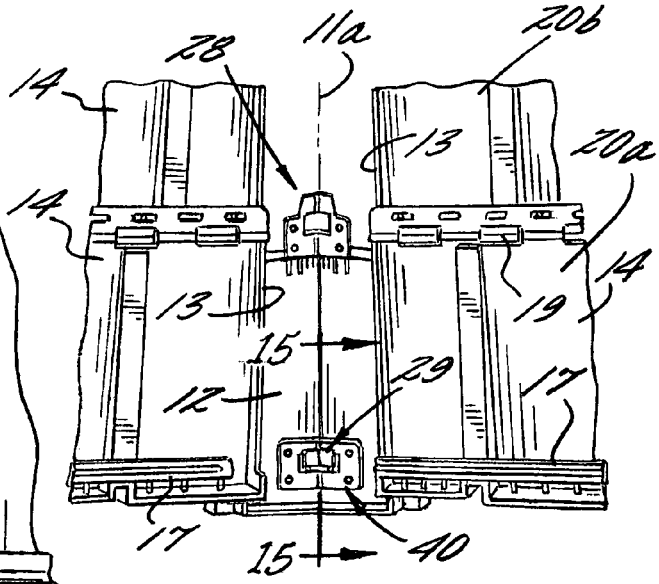
FIG. 14 is a rear fragmentary view of the initial or lower most corner molding mounted between previously installed wall panels.

In keeping with the invention, the corner moldings 12 are designed to permit efficient and unencumbered mounting of the wall panels 14 on the wall surfaces 11 prior to mounting of the corner moldings 12. As is known in the art, the wall panels 14 typically are mounted on the support surfaces 11 of the building wall or roof structure in horizontal courses, beginning with the lower most course, with the right-side marginal edge region in underlying relation to the left-side marginal edge region of the wall panel 14 immediately to the right thereof and with the lower marginal edge region of the wall panels 14 in each course overlying the upper marginal edge region of the wall panel in the course immediately below. To begin each course, the left hand edge of the wall panel is cut with a straight edge, and in this case, positioned a predetermined distance "d" from an edge 11*a* of the corner defined by the wall surfaces 11, such as the two as depicted in FIG. 10.

Figure 3:
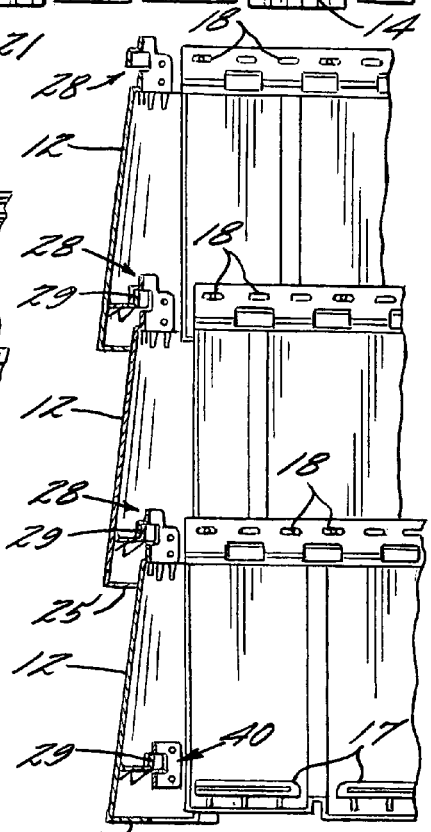
FIG. 3 is an enlarged vertical section of the illustrated corner construction taken in the plane of line 3-3 in FIG. 2.
Figure 4:
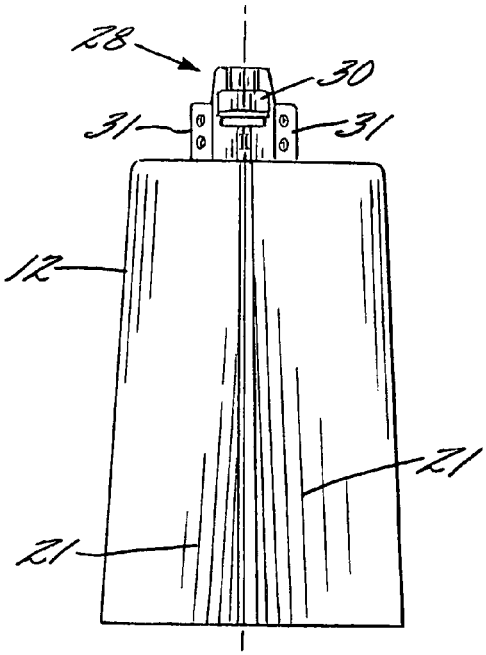
FIG. 4 is an enlarged front view of one of the corner moldings of the illustrated wall covering.
Figure 5:
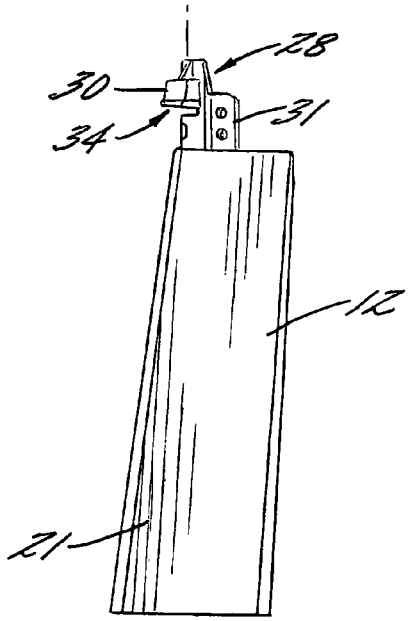
FIG. 5 is a side elevational view of the corner molding shown in FIG. 4.

For securing the wall panels 12 to the wall surfaces 11, an upper marginal edge region of each wall panel 14 is formed with a row of elongated laterally spaced fastener receiving apertures 18. The upper marginal edge region further is formed with a forwardly and downwardly directed locking rail 19 or fingers (FIG. 1) which is engaged by upturned, rearwardly directly inner-lock flanges 17 (FIG. 3) of an overlying wall panel 14 during installation of the next vertical adjacent course of wall panels. In the following description, when discussing the interaction of panels disposed in vertically displaced courses, the lower most course of wall panels 14 will be designated with the reference numeral "20*a*" and the subsequent courses of wall panels will be designated with the reference numerals "20*b*", "20*c*" etc. This convention is employed solely for clarifying the relative positions and order of installation of the wall panels 14 since the wall panels 14 typically are identically molded.

The illustrated corner moldings 12, which again may be made of molded thermoplastic material, each are formed with a single tier of simulated building elements 21 in the form of a shake disposed substantially at a right angle to each other similar to the wall surfaces 11. The building elements 21 have outer faces extending in downwardly and outwardly tapered fashion, similar to the simulated shake of the wall panels 14.

In accordance with an important aspect of the invention, the building elements of the corner moldings are mountable in overlying relation to the building elements of laterally adjacent wall panels and have upper marginal edge regions which are positionable into underlying relation to the building elements of wall panels in the course immediately above the corner molding for providing a more natural appearing shake shingle corner construction. To this end, each corner molding 12 is formed with rearwardly directed side flanges 24 which are positionable in overlying engaging relation with the simulated shake shingle of immediately adjacent wall panels 14 and rearwardly directed bottom flanges 25 that are positionable into overlying engaging relation with the building elements of an underlying corner molding 12. The side flanges 24 have a tapered configuration which increases from top to bottom for supporting the corner molding with the outer face with a downwardly and outwardly tapered orientation consistent with naturally installed cedar shake. It will be appreciated by one skilled in the art that since the simulated building elements 21 of the corner moldings 12 overly the simulated building elements 16 of the adjacent wall panels 14, the installer need not exercise precise accuracy in cutting the ends of the wall panels 14 that start each course, thereby enabling quicker and more efficient installation. Moreover, since the rearwardly directed side and bottom flanges 24,25 are retained in engaging relation with the upper surfaces of the simulated building elements of the adjacent wall panels 14 and underlying corner molding 12, as will become apparent, there are no unsightly gaps therebetween which can accumulate water, dirt, or other contaminants.

In carrying out the invention, the upper marginal edge regions of the corner molding building elements are shaped to facilitate forceful positioning between the simulated building element of the wall panel in the course immediately above the corner molding to further provide an aesthetic and more natural appearance upon installation. For this purpose, the front faces corner molding building elements 21 and the tapered side flanges 24 define a chamfer or taper 24*a* that narrows in an upward direction to relatively pointed upper ends that can be more easily and forcefully wedged under a previously installed wall panel 14 to the appropriately mounted position as indicated in FIG. 10. If necessary, a slight lifting pressure can manually be exerted on the wall panel 14 to facilitate insertion of the upper chamfered end of the corner molding 12 under the wall panel 14. The forceful overlapping engagement of the wall panels 14 with the building elements 16 of the corner molding 12 both prevents the existence of unsightly gaps and further simulates the natural appearance of overlying shake.

In keeping with the invention, frictional forces resulting from the upper marginal edge regions 24*a* of the corner molding building elements being wedged in underlying relation to the wall panel will support the corner molding 12 for sufficient hang time to enable the installer to handle nails, screws, or other fasteners and to install the corner molding 12 without the necessity for physically holding and retaining the corner molding in place. As used herein, the term "hang time" means the time the corner molding will be retained by frictional engagement of the overlying wall panel without the need for manually supporting the weight of the corner molding.

In further carrying out the invention, the corner moldings each have latch and hook mechanisms for facilitating positioning and mounting of the corner moldings in predetermined relation to the previously installed wall panels and corner moldings and for reliably retaining the corner moldings in mounted position. To this end, each corner molding 12 has a mounting and latch mechanism 28 that extends upwardly and forwardly from the upper marginal edge regions of the building elements 21 and a latch engaging hook 29 that extends rearwardly of the corner molding adjacent a lower end thereof. The latch and mounting mechanism 28 in this case comprises a pair of mounting flanges 31 which extend upwardly from upper peripheral edges of the simulated building elements of the corner molding 12 in right angle relation to each other and a forwardly protruding latch 30 disposed centrally at near an upper end of the mounting flanges 31. The mounting flanges 31 are positionable on the wall surfaces 11 about the corner and each are formed with a pair of longitudinally aligned fastener receiving apertures 31*a*, although each corner molding may be reliably secured to the wall surfaces using the two upper most fastening receiving apertures 31*a*. The lower two apertures 31 a may be backup apertures in case of a metal or other instruction that would prevent use of the top fastening apertures. Reinforcing ribs 32 extend downwardly from the mounting flange into blended relation with rear sides of the building elements.

The latch 30 in this case comprises a forwardly extending latch structure, having right angled walls 30*a* for defining a downwardly opening hook receiving aperture 34 in an underside thereof. Reinforcing ribs 35 extend between the upper peripheral portion of the mounting flanges 29 and an upper wall that supports and encloses a top side of the latch.

The latch hook 29 of each corner molding 12 in this case has an upwardly extending V-shape defined by a pair of right angle flanges sized complementary to the downwardly opening hook receiving aperture 34 of the latch 30. The latch hook 29 is supported by a horizontal mounting flange 38 that projects rearwardly of the corner molding, which in turn is supported by four parallel reinforcing ribs 39 that extend between the rear walls of the corner molding and the under side of the horizontal flange 38. The horizontal mounting flange 38 in this case is formed with recesses between the reinforcing ribs 39 to permit air circulation and water drainage in the event that moisture should get behind the corner molding.

The latch hook 29 is designed to inter-engage with the latch 30 of a previously mounted corner molding 12 for purposes of precisely aligning the coming molding in relation to a previously mounted corner molding 12 and to retain a building elements 21 of the corner molding in engaging relation with the building elements of the adjacent wall panels and the corner molding. As will become apparent, the upstanding hook 29 of each corner molding is positionable into the bottom opening aperture 34 of a previously installed corner molding 12 as an incident to upward positioning of the corner molding during its installation. Once properly positioned, the mounting flanges 31 can be nailed or screwed to the wall surfaces 11 and the lower end of the corner molding 12 will be captively retained by the interengaged hook and latch to prevent outward movement of the corner molding with respect to the underlying wall panels and the previously mounted corner molding.

In installing the wall covering 10, as indicated above, the wall panels 14 can be completely installed first, beginning with the lower-most course 20*a*, without cumbersome handling of or assembly with the corner moldings 12. The edge 13 of each wall panel 14 adjacent the corner is cut straight and mounted a distance "d" from the corner edge sufficient to permit ultimate positioning of the mounting flanges 31 of the corner moldings 12 onto the wall surfaces 11. The successive courses 20*a*, 20*b*, 20*c* of wall panels 14 are similarly installed all without handling of corner molding.

Following installation of the wall panels 14, the corner moldings 12 also are installed beginning with the lower-most corner molding. To facilitate installation of the first corner molding 12, a starting clip 40 similar to the mounting and latch mechanism 28 of the corner moldings 12 is utilized. The starting clip 40 includes a pair of perpendicularly oriented mounting flanges 41 formed with fastening apertures 42 and a forwardly directed latch 44 and hook receiving aperture 45, similar to that of corner molding 12. The starter clip 40 is mounted on the wall surfaces 11 adjacent the lower ends of the first course 20*a* of wall panels 14, using either two or four fastener receiving apertures 42. Following mounting of the starting clip 40, the first corner molding 12 may be installed by sliding the corner molding 12 upwardly such that the hook 29 thereof engages the latch 44 of the starter clip 40 as the upper peripheral edges of the corner molding building elements are slid into underlying relation with the wall panel 12 in the course 20*b* immediately above the corner molding 12. By appropriate positioning of the starter clip, upward insertion of the corner molding hook into the latch 44 of the starter clip 40 will locate and position the corner molding 12 in proper relation to the wall panels 14 of the first course 20*a* such that it can be secured to the wall panel by screws, utilizing two of the mounting flange fastener receiving apertures 31. Engagement of the hook 29 with the starting clip latch 44 will retain the lower end of the corner molding 12 in overlying engagement with the wall panels 12 in the adjacent course 20*a*.

Successive corner moldings 12 can be similarly and successively installed by such upward movement which engages the hook 29 of the corner molding 12 being mounted with the latch 30 of the previously mounted corner molding 12 simultaneous with the upper marginal edge regions of the corner molding building elements 21 being slid into underlying relation with the wall panels 14 in the course 20*c* immediately above the corner molding. The hook and latch 29, 30 of the corner moldings 12 both locate and retain proper positioning of the corner molding. Hence, it will be appreciated by one skilled in the art that the latch and hook mechanisms of the corner moldings permit a simple, reliable and efficient technique for installing the corner moldings after the wall panels all have been previously mounted. The hook and latch mechanisms further enable the corner moldings to precisely line up with the previously mounted corner moldings and wall panels and be retained in secure engagement therewith without unsightly gaps.

Figure 2:
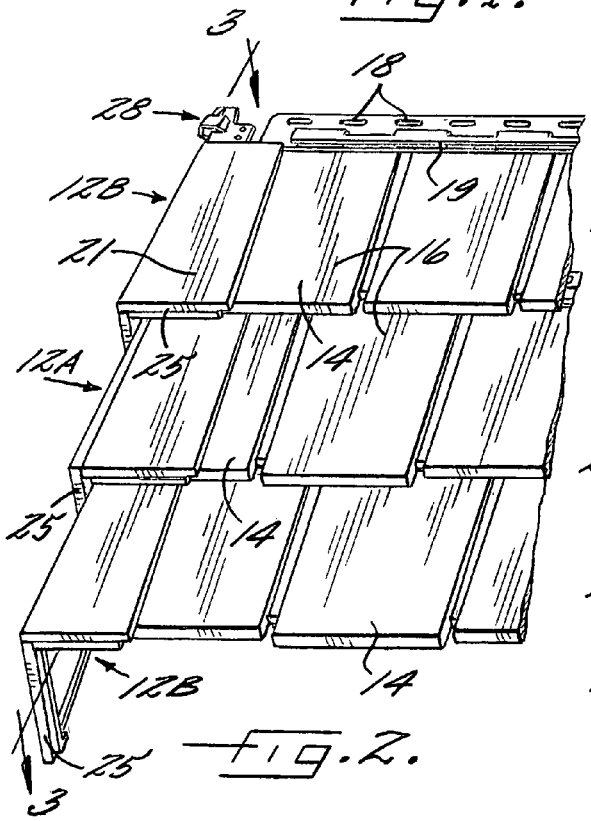
FIG. 2 is an enlarged perspective of the corner construction of the wall covering shown in FIG. 1.
Figure 6A:
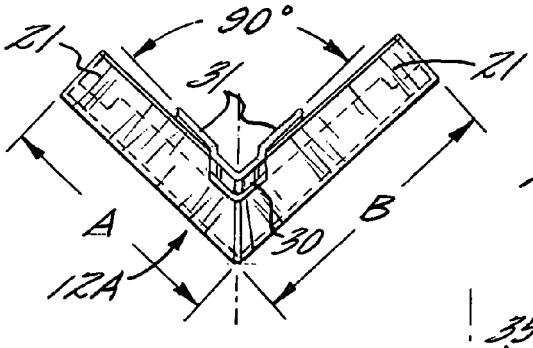
FIGS. 6*a* and 6*b* are top views of two different forms of corner moldings of the illustrated wall covering.
Figure 6B:
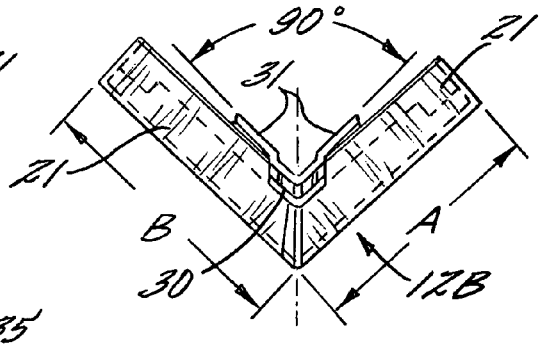
Figure 7:
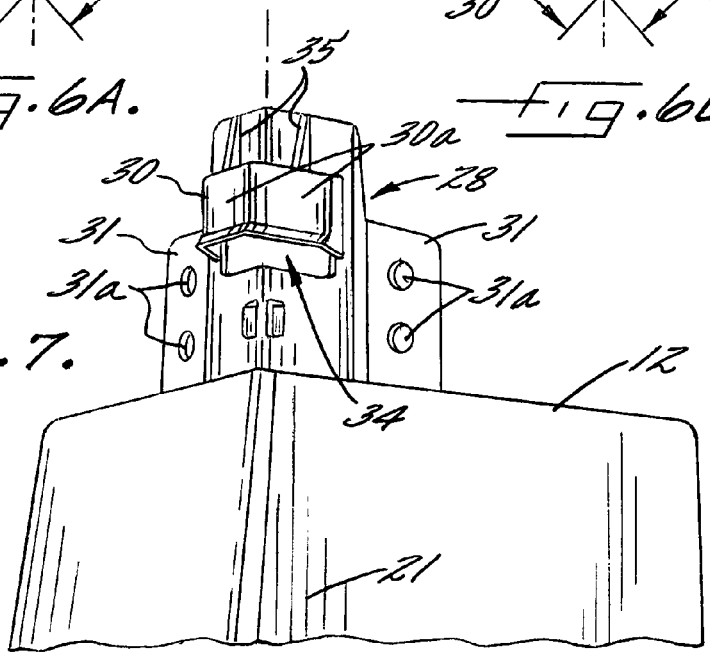
FIG. 7 is an enlarged fragmentary front perspective of an upper end of the corner molding shown in FIG. 4, showing an upper latch mechanism thereof.
Figure 8:
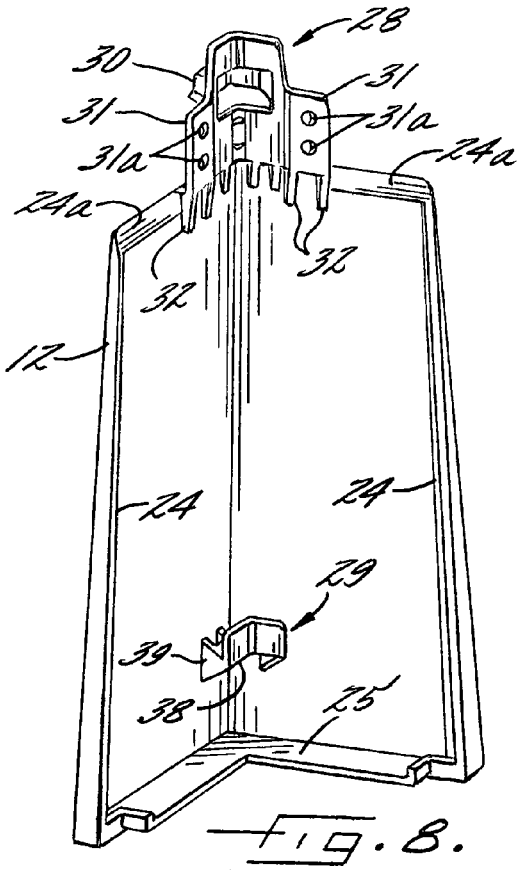
FIG. 8 is a rear perspective of the corner molding shown in FIG. 7.
Figure 9:
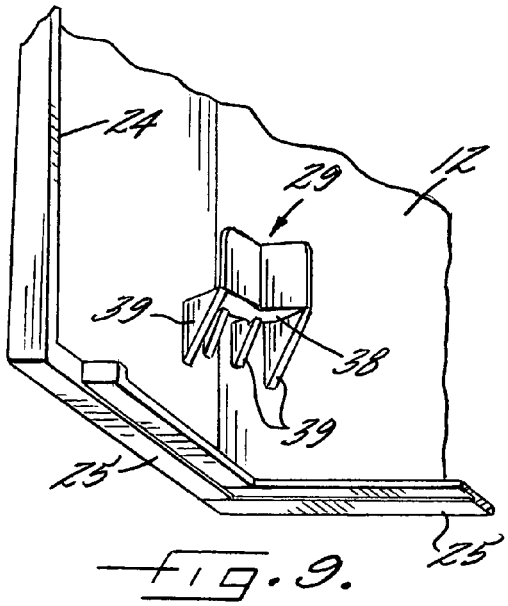
FIG. 9 is an enlarged fragmentary rear perspective of the lower end of the corner molding shown in FIG. 8 showing a lower latch hook thereof.

In accordance with a further aspect of the invention, the corner moldings may have different configurations of simulated building elements and are mountable in alternating repeating fashion for further providing an appearance typical of a natural cedar shake corner constructions. To this end, in the illustrative embodiment, the corner moldings 12 have two different configurations, designated as 12A, 12B in FIGS. 6A-6B. In the illustrated embodiment, the building elements 21 of the corner moldings 12A have different widths than the building elements of the corner moldings 12B, such that when mounted in alternating fashion, as depicted in FIG. 2, the building elements create a lacing or non-uniform edge effect in overlying relation to wall panels for effecting a look more realistic of hand cut cedar shake appearance. In the illustrative embodiment, in the corner molding 12A the right hand building element, as viewed in FIG. 6A, has a length B greater than the length A of the left hand building element of the corner molding. In the corner molding 12B, the right hand building element 21, as viewed in FIG. 6B, has a shorter width A than the longer width B of the left hand building element.

Figure 16:
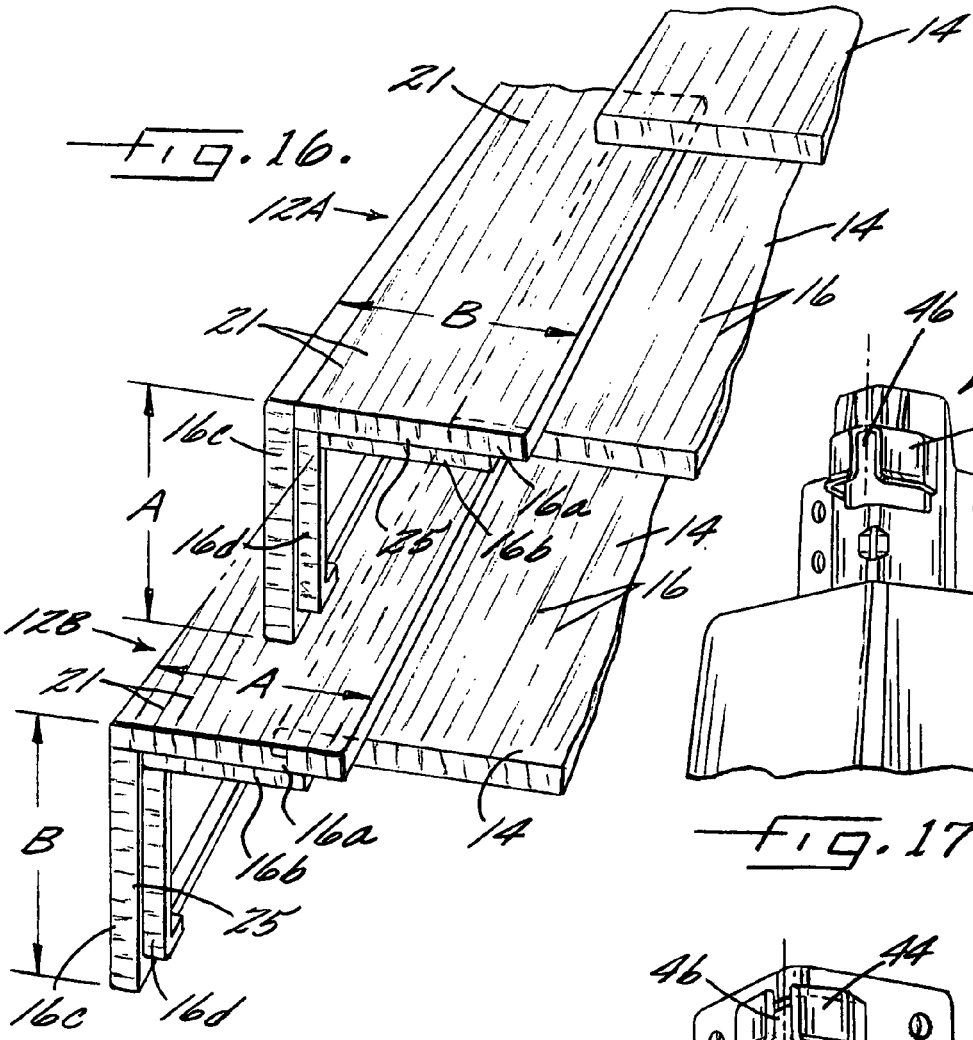
FIG. 16 is an enlarged fragmentary end perspective of the illustrated wall covering.

In further carrying out this aspect of the invention, the rearwardly extending bottom flanges 25 of the corner moldings 12 define a stacked arrangement of four building elements 16*a*, 16*b*, 16*c*, or 16*d*, as depicted in FIG. 16, with the outer building elements 16*a*, 16*c* partially overlying the inner building elements 16*b*, 16*d* and with the inner building elements 16*b*, 16*d* having a shorter width than the outer building elements 16*a*, 16*c*. The inner or bottom building element 16*b*, 16*d* also are recessed relative to the outer building elements 16*a*, 16*c*. In the mounted position, such a stacked appearance of simulated shake about the corner of the wall surfaces again depicts a more natural hand cut cedar shake appearance.

In keeping with this aspect of the invention, the stacked simulated building element design defined by the bottom flanges 25 for corner molding 12A is different than stacked building element design of corner molding 12B. In the corner molding 12A, the right hand building elements 16*a*, 16*b* abut side surfaces of the left hand building elements 16*a*, 16*d*. In the corner molding 12B, the right hand building elements 16*a*, 16*b* overly end faces of the left hand building elements 16*c*, 16*d*. Again, such alternating design of the building elements enhances the natural hand cut appearance of the shake shingles.

Figure 17:
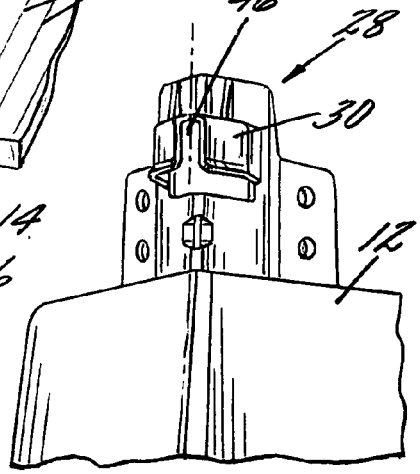
FIG. 17 is a fragmentary front perspective of an upper end of a corner molding with the latch mechanism thereof longitudinally cut to facilitate mounting of the corner molding about wall surfaces that define angles greater than 90°.
Figure 19:
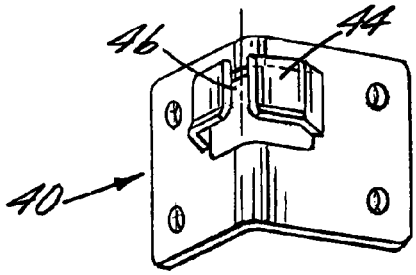
FIG. 19 is a perspective of the illustrated starter clip with the latch mechanism thereof longitudinally cut to similarly facilitate mounting on wall surfaces that define angles greater than 90°.
Figure 18:
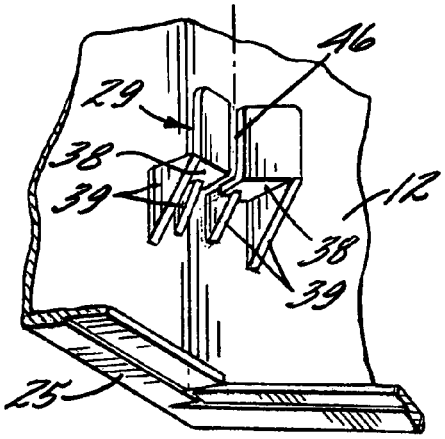
FIG. 18 is a fragmentary rear perspective of the illustrated corner molding having the lower hook thereof longitudinally cut to facilitate mounting of the corner molding about a corner having wall surfaces angled greater than 90°.
Figure 20:
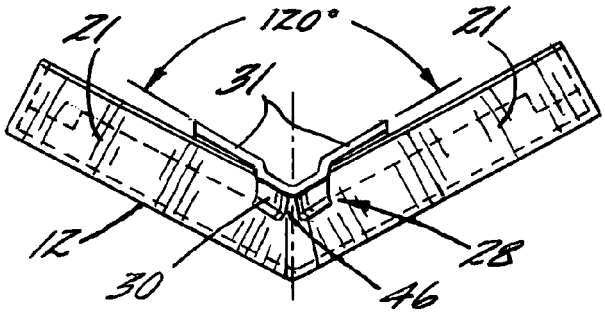
FIG. 20 is a top view of the corner molding shown in FIGS. 17 and 18 positioned on a corner having wall surfaces that form an angle of 120° to each other.

In carrying still a further feature of the invention, while the corner moldings 12 are molded as a single unitary part designed for mounting on right angled corners, the corner moldings 12 are readily adapted for mounting on wall surfaces that are angled substantially greater than 90°, such as the wall surfaces about bay windows which may define angles of 120° or greater. To this end, the corner molding latch 30 and hook 29 of the corner molding may be longitudinally cut, such a by a knife, down the middle, as depicted at 46 in FIGS. 17 and 18, so as to permit expansion of the latch and hook and sides of the corner molding to accommodate wall surfaces that are angled greater than 90°. Likewise, the latch 44 of the starting clip 40 may be similarly cut. In each case, the latch and hook may be readily severed longitudinally along the juncture between their angled flanges. Notwithstanding such severing, it has been found the hooks and latches remain inter-engageable and effectively locate and retain the corner moldings 12 in mounted position. In this regard, the severed flanges that define the hooks 29 each remain supported by a pair of reinforcing and support ribs 39.

From the foregoing, it is seen that a wall covering has corner moldings that facilitate more efficient and reliable installation of the wall covering about corners of roofs and side walls with a more natural and aesthetic appearance. The corner moldings are adapted for efficient and reliable mounting subsequent to complete installation of the wall panels without unsightly gaps between the corner moldings and wall panels. The corner moldings, furthermore, may have different designs which simulates the appearance of natural hand cut cedar shake, and the corner moldings are usable both on right angled wall surfaces and wall surfaces that define substantially greater angles.

The invention claimed is:

1. A wall covering for a pair of wall surfaces that form a corner comprising:

a plurality of elongated wall panels each formed with a plurality of simulated building elements, said wall panels being mounted on said wall surfaces in a plurality of horizontal courses with an exposed lower marginal edge region of each wall panel in partially overlying relation to an upper marginal edge region of a previously mounted course of said wall panels, a plurality of corner moldings mountable on said wall surfaces subsequent to and in laterally adjacent relation to said wall panels of horizontally adjacent courses, said corner moldings each being formed by a pair of building elements disposed at an angle to each other corresponding substantially to the angle of the wall surfaces that define a corner upon which the corner molding is mounted, said corner moldings being mounted on the corner of said wall surfaces with the building elements thereof in partially overlying relation to the building elements of the wall panels of horizontally adjacent courses with underlying portions of the building elements of the adjacent wall panels being disposed entirely below the corner molding in interposed relation between said wall surfaces and said corner molding, and said corner moldings being mounted and with upper marginal edge regions of the corner molding building elements being positioned in underlying relation to lower marginal edge regions of the wall panels in a course immediately above the horizontal adjacent course of wall panels.

2. The wall covering of claim 1 in which said corner moldings are mounted with building elements thereof in partially overlying relation to the building elements of an underlying previously mounted corner molding.

3. The wall covering of claim 1 in which the upper marginal edge regions of the building elements of said corner moldings are positioned in underlying relation to the wall panel in a course immediately above the corner molding with sufficient frictional contact as to support the weight of the corner molding without manual support during mounting of the corner molding on the wall surfaces.

4. The wall covering of claim 1 in which said corner molding building elements have rearwardly directed side flanges for bearing overlying engagement with the building elements of horizontally adjacent wall panels and rearwardly directly bottom flanges for bearing engagement with the building elements of an underlying corner molding.

5. The wall covering of claim 4 in which said bottom flanges of said corner molding each define an overlying stacked arrangement of building elements.

6. The wall covering of claim 4 in which said side flanges have a narrowing tapered configuration in an upward direction for defining a chamfered upper end to facilitate forceful positioning the corner molding building elements in underlying relation to a previously mounted wall panel in a course above the corner molding.

7. A wall covering for a pair of wall surfaces that form a corner comprising:

a plurality of elongated wall panels each formed with a plurality of simulated building elements, said wall panels being mounted on said wall surfaces in a plurality of horizontal courses with a lower marginal edge region of each wall panel in partially overlying relation to an upper marginal edge region of a previously mounted course of said wall panels, a plurality of corner moldings each laterally adjoining the wall panels of horizontally adjacent courses, said corner moldings each being formed by a pair of building elements disposed at an angle to each other corresponding substantially to the angle of the wall surfaces that define a corner upon which the corner molding is mounted, said corner moldings being mounted on the corner of said wall surfaces with the building elements thereof in partially overlying relation to the building elements of the wall panels of horizontally adjacent courses and with upper marginal edge regions of the corner molding building elements being positioned in underlying relation to lower marginal edge regions of the wall panels in a course immediately above the horizontal adjacent course of wall panels, each said corner molding having a mounting and latch mechanism extending upwardly from the upper marginal edge region of the building elements and a latching engaging hook extending rearwardly of the corner molding adjacent a lower end thereof, said mounting and latch mechanism comprising mounting flanges for mounting the corner molding on the wall surfaces and a latch having a downwardly opening hook receiving aperture, said hook of one corner member being engageable with the downwardly opening hook receiving aperture of the previously mounted corner molding for aligning the corner molding in relation to the previously mounted corner molding, and said engaged hook and latch being operative for captively retaining the building elements of the corner molding in engaging relation with the building elements of the adjacent wall panels and underlying corner molding and preventing outward movement of a lower end of the corner molding with respect to the underlying wall panels and previously mounted corner molding.

8. The wall covering of claim 7 including a starting clip mountable on the wall surfaces between the wall panels of the lower most horizontal courses, said starting clip comprising a pair of mounting flanges positioned on the wall surfaces about the corner and a forwardly directly latch defining a downwardly opening hook receiving aperture for receiving a hook of a first lower-most corner molding of the wall covering as an incident to mounting of the first corner molding and for retaining the corner molding in aligned and overlying relation with building elements of horizontally adjacent wall panels.

9. The wall covering of claim 7 in which said corner moldings each are molded with said building elements disposed at a right angle to each for mounting on right angled corners, and said latch and hook of each corner molding being longitudinally severable to permit mounting of the corner molding on wall surfaces that define angles of at least 120.degree. while permitting interengagement of the longitudinally severed latch and hooks of overlapping corner moldings during mounting.

10. The wall covering of claim 9 in which said latch comprises angled walls which define said downwardly opening hook receiving aperture in an underside thereof, and said hook of each corner molding has an upwardly extending V-shape defined by a pair of angled flanges sized complementary to the downwardly opening hook receiving aperture of the latch, and said latch and hook being longitudinally severable along the respective junctions of said angled walls and flanges.

11. The wall covering of claim 10 including a starting clip mountable on the wall surfaces between the wall panels of the lower most horizontal courses, said starting clip comprising a pair of mounting flanges positioned on the wall surfaces about the corner and a forwardly directly latch defining a downwardly opening hook receiving aperture for receiving a hook of a first lower-most corner molding of the wall covering as an incident to mounting of the first corner molding and for retaining the corner molding in aligned and overlying relation with building elements of horizontally adjacent wall panels, and said starting clip hook being longitudinally severable to permit mourning of said starting clip on wall surfaces that define angles of at least 120.degree. while permitting inner-engagement of the longitudinally severed starting clip hook with a longitudinally severed latch of a mounted corner molding.

12. The wall covering of claim 1 in which said corner moldings and wall panels each are formed with a single tier of simulated building elements.

13. A wall covering for a pair of wall surfaces that form a corner comprising:

a plurality of elongated wall panels each formed with a plurality of simulated shake shingle, said wall panels being mounted on said wall surfaces in a plurality of horizontal courses with a lower marginal edge region of each wall panel in partially overlying relation to an upper marginal edge region of a previously mounted course of said wall panels, a plurality of corner moldings each laterally adjoining the wall panels of horizontally adjacent courses, said corner moldings each being formed with simulated shake shingles disposed at an angle to each other corresponding substantially to the angle of the wall surfaces that define a corner upon which the corner molding is mounted, each corner molding having lateral marginal edges and upper marginal edge regions, said corner molding being mounted on the corner of said wall surfaces with its lateral marginal edges being in partially overlying relation to building elements of the horizontally adjacent courses and with its upper marginal edge regions being positioned in underlying relation to lower marginal edge regions of the wall panels in a course immediately above the horizontal adjacent course of wall panels, said corner moldings including a first form of corner molding having a first form of simulated shake shingle design, said corner moldings including a second form of corner molding having a second form of shake shingle design different from said first form, and said corner moldings of said first form and second form being mounted on said corner of said wall surfaces in a repeating alternating sequence.

14. The wall covering of claim 13 in which said corner moldings have at least one simulated shake shingle on a right side thereof disposed at an angle to at least one simulated shake shingle on a left side thereof, said corner moldings of said first form have a simulated shake shingle on the right side thereof that has a greater horizontal width than the simulated shake shingle on the left side, and said corner moldings of said second form have a simulated shake shingle on a right side that has a lesser horizontal width than the simulated shake shingle on the left side.

15. The wall covering of claim 13 in which said corner moldings each are formed with a stacked arrangement of two simulated shake shingles on a right side thereof and a stacked arrangement of two shake shingles on a left side thereof disposed at an angle to the simulated shake shingle on the right, and each said stacked arrangement of simulated shake shingles includes an outer shake shingle and underlying inner shake shingle.

16. The wall covering of claim 15 in which said inner and outer shake shingles of each stacked arrangement have different horizontal widths.

17. The wall covering of claim 16 in which each said inner simulated shake shingles is recessed longitudinally with respect to an overlying outer shake shingle.

18. The wall covering of claim 16 in which each said stacked arrangement of simulated shake shingle is defined by a rearwardly directly bottom flange of the corner molding.

19. The wall covering of claim 13 in which said corner moldings each have rearwardly directed side flanges which define tapered sides of simulated cedar shake shingles.

20. A one piece corner molding for a wall covering mountable on two wall surfaces that form a corner and which includes a plurality of laterally adjacent wall panels each formed with a plurality of simulated building elements comprising:

a pair of building elements disposed at an angle to each other corresponding substantially to the angle of the wall surfaces that define a corner upon which the corner molding is mounted, said building elements have rearwardly directed side flanges for bearing overlying engagement with the building elements of horizontally adjacent wall panels and rearwardly directly bottom flanges for bearing engagement with the building elements of an underlying corner molding, a mounting and latch mechanism extending upwardly from the upper marginal edge region of the building elements, a latching engaging hook extending rearwardly of the corner molding, the engaging hook being attached to a rear surface of the corner molding at a location that is spaced apart from a lower end thereof so as to provide a mounting location above the lower end of the corner molding, said mounting and latch mechanism comprising mounting flanges for mounting the corner molding on the wall surfaces and a latch having a downwardly opening hook receiving aperture, said hook of an upper corner member being engageable with the downwardly opening book receiving aperture of the previously mounted lower corner molding for aligning the upper corner molding in relation to the previously mounted lower corner molding, and said engaged hook and latch being operative for captively retaining the building elements of the corner molding in engaging relation with the building elements of the adjacent wall panels and underlying corner molding and preventing outward movement of a lower end of the corner molding with respect to the underlying wall panels and previously mounted corner molding, the engagement of the hook of the upper corner molding with the aperture of the lower corner molding operating to capture lower marginal edge regions of the horizontal courses adjacent to the upper corner molding between lower marginal edge regions of the upper corner member and upper marginal edge regions of the lower corner member.

21. The wall covering of claim 20 in which said bottom flanges each define an overlying stacked arrangement of building elements comprising an outer building element and an underlying inner building element with a width different than the outer building element.

22. The wall, covering of claim 21 in which said inner building element of each stacked arrangement is recessed longitudinally relative to the outer building element.

23. The wall covering of claim 20 in which said side flanges have a narrowing tapered configuration in an upward direction for defining a chamfered upper end to facilitate forceful positioning the corner molding building elements in underlying relation to a previously mounted wall panel in a course above the corner molding.

24. The wall covering of claim 20 in which said latch extends forwardly of the mounting flanges thereof.

25. The wall covering of claim 24 in which the latch of each corner molding comprises a forwardly extending latch structure having angled walls which define said downwardly opening hook receiving aperture in an underside thereof.

26. The wall covering of claim 25 in which said hook of each corner molding has an upwardly extending V-shape defined by a pair of angled flanges sized complementary to the downwardly opening hook receiving aperture of the latch.

27. A one piece corner molding for a wall covering mountable on two wall surfaces that form a corner and which includes a plurality of laterally adjacent wall panels each formed with a plurality of simulated building elements comprising:

a pair of building elements disposed at an angle to each other corresponding substantially to the angle of the wall surfaces that define a corner upon which the corner molding is mounted, a stacked arrangement of at least two simulated shake shingles on a right side thereof and a stacked arrangement of two shake shingles on a left side thereof disposed at an angle to the simulated shake shingle on the right, said left and right stacked arrangements of simulated shake being disposed at an angle to each corresponding substantially to the angle of the wall surfaces that define a corner upon which the corner molding is mounted, and each said stacked arrangement of simulated shake shingles includes an outer shake shingle and underlying inner shake shingles wherein a lateral marginal edge of each of the left and right stacked arrangement partially overlies a lateral edge of an adjacent building element, and an upper marginal edge region of each of the left and right stacked arrangement is positioned underneath a lower marginal edge region of a building element located immediately above the adjacent building element.

28. The wall covering of claim 27 in which said inner and outer simulated shake shingles of each stacked arrangement have different horizontal widths.

29. The wall covering of claim 28 in which said outer shake shingle of each stacked arrangement has a greater horizontal width than the inner shake shingle.

30. The wall covering of claim 28 in which each said inner simulated shake shingle is recessed longitudinally with respect to an overlying outer shake shingle.

31. The wall covering of claim 28 in which each said stacked arrangement of simulated shake shingle is defined by a rearwardly directly bottom flange of the corner molding.

32. The wall covering of claim 27 in which said corner moldings each have rearwardly directed side flanges which define tapered sides of simulated cedar shake shingles.

* * * * *